US010053836B2

(12) United States Patent
Lucieer

(10) Patent No.: US 10,053,836 B2
(45) Date of Patent: Aug. 21, 2018

(54) VACUUM CONTROL METHOD FOR A RISER LINE

(71) Applicant: IHC HOLLAND IE B.V., Sliedrecht (NL)

(72) Inventor: Pieter Abraham Lucieer, Rotterdam (NL)

(73) Assignee: IHC Holland IE B.V., Sliedrecht (NL)

( * ) Notice: Subject to any disclaimer, the term of this patent is extended or adjusted under 35 U.S.C. 154(b) by 215 days.

(21) Appl. No.: 14/904,626

(22) PCT Filed: Jul. 10, 2014

(86) PCT No.: PCT/NL2014/050469

§ 371 (c)(1),
(2) Date: Jan. 12, 2016

(87) PCT Pub. No.: WO2015/005786

PCT Pub. Date: Jan. 15, 2015

(65) Prior Publication Data

US 2016/0168820 A1 Jun. 16, 2016

(30) Foreign Application Priority Data

Jul. 12, 2013 (NL) ..... 2011160

(51) Int. Cl.
*E02F 3/90* (2006.01)
*E02F 3/88* (2006.01)
(Continued)

(52) U.S. Cl.
CPC ..... *E02F 3/907* (2013.01); *E02F 3/885* (2013.01); *E02F 3/905* (2013.01); *E02F 3/94* (2013.01);
(Continued)

(58) Field of Classification Search
CPC . E02F 3/907; E02F 3/885; E02F 3/905; E02F 3/94; E02F 7/065; E02F 7/10; E21C 50/00
See application file for complete search history.

(56) References Cited

U.S. PATENT DOCUMENTS 3,109,377 A * 11/1963 Hofer ..... E02F 3/907 137/487.5
3,673,716 A * 7/1972 Trondle ..... E02F 3/9231 37/322
(Continued)

FOREIGN PATENT DOCUMENTS

EP 0 559 993 A1 9/1993
JP 2012193578 A 10/2012
(Continued)

OTHER PUBLICATIONS

"Water Supply and Drainage Engineering", Wu Junqi, et al. pp. 260 and 261, China Water Power Press, version 1.
(Continued)

*Primary Examiner* — Jamie L McGowan
(74) *Attorney, Agent, or Firm* — NLO; Catherine Shulz; Tamara Stegmann

(57) ABSTRACT

A method for deep sea mining includes generating an upward flow of valuable matter in a riser line from the bottom of a body of water to a matter processing platform; processing the matter at the processing platform; generating a return flow in a return pipe of a mixture of seawater and a non-valuable part of the matter from the processing platform towards the bottom of the body of water; and controlling the pressure in the return pipe for avoiding collapse of the return pipe and/or cavitation of the return pipe, in particular for avoiding collapse of or cavitation in an upper part of the return pipe.

15 Claims, 1 Drawing Sheet

(51) Int. Cl.

| | |
|---|---|
| ***E02F 7/06*** | (2006.01) |
| ***E02F 7/10*** | (2006.01) |
| ***E21C 50/00*** | (2006.01) |
| ***E02F 3/94*** | (2006.01) |

(52) U.S. Cl.
CPC ..... *E02F 7/065* (2013.01); *E02F 7/10* (2013.01); *E21C 50/00* (2013.01)

(56) References Cited

U.S. PATENT DOCUMENTS

| | | | | |
|---|---|---|---|---|
| 3,693,272 | A * | 9/1972 | Gariel | E02F 3/8875 37/309 |
| 6,454,022 | B1 | 9/2002 | Sangesland et al. | |
| 8,678,514 | B2 * | 3/2014 | Efthymiou | E02F 3/8866 299/8 |
| 9,222,320 | B2 * | 12/2015 | Varpe | E21B 21/106 |
| 2012/0234552 | A1 | 9/2012 | Vaughan | |
| 2016/0168820 | A1 * | 6/2016 | Lucieer | E02F 3/885 299/1.05 |

FOREIGN PATENT DOCUMENTS

| | | | |
|---|---|---|---|
| WO | 2009/011710 | A1 | 1/2009 |
| WO | 2011/122942 | A1 | 10/2011 |
| WO | 2011/156867 | A1 | 12/2011 |
| WO | 2012/091706 | A1 | 7/2012 |

OTHER PUBLICATIONS

English translation of Chinese Office Action, dated Mar. 10, 2017.
International Search Report dated Aug. 25, 2014, in corresponding PCT application.

* cited by examiner

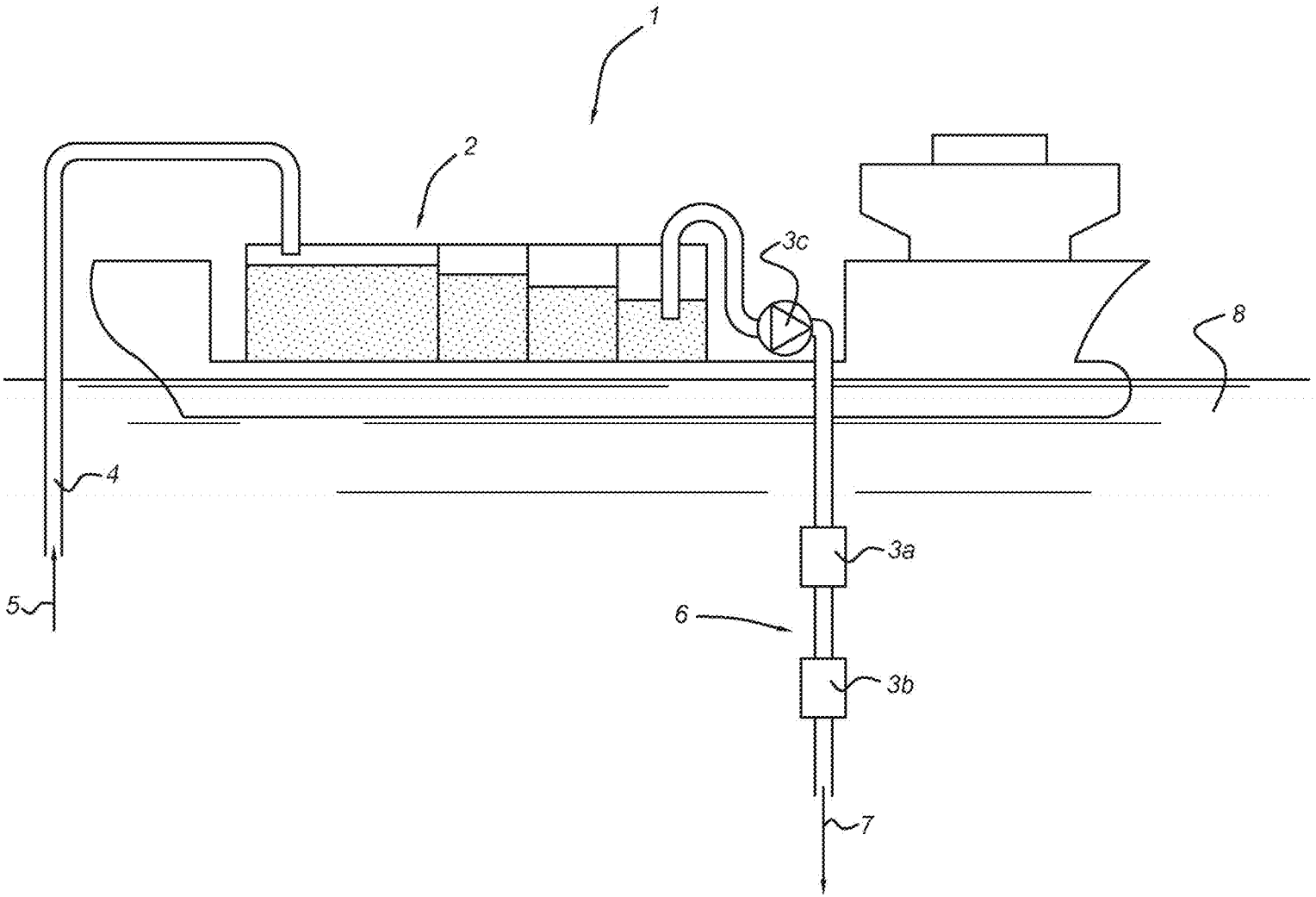
1
2
3c
8
3a
3b
6
7
4
5

VACUUM CONTROL METHOD FOR A RISER LINE

BACKGROUND

The present invention relates to a mining method for deep sea.

WO2012091706 relates to a subsea pressure control system for a well annulus, which system includes s subsea choke which variably restricts flow of drilling fluid from a well annulus to a surface location, the choke being positioned at a subsea location, and a subsea process control system which automatically operates the subsea choke, whereby a desired pressure is maintained in the well annulus.

In general when material is excavated at the seafloor, pumped upward to a vessel and processed, the transported volume mostly contains waste. These will be returned via a pipe downward to the seafloor. In mining, slurry heavier than water will be returned to the seafloor. If the hydrostatic pressure of the slurry column in the return pipe is higher than sum of the friction losses and the water column pressure, than a high risk of vacuum at top of return pipe remains.

SUMMARY OF THE INVENTION

The invention aims to improve the controllability of a return flow in a deep sea mining system.

Another object of the invention is to improve a known deep sea mining method in that a problem associated therewith is at least partly solved.

Yet another object of the invention is to provide an alternative deep sea mining method.

According to a first aspect of the current invention the object is realized with a method for deep sea mining comprising;

- generating an upward flow of excavated matter in a riser line from the bottom of a body of water to a matter processing platform,
- processing the matter at the processing platform into a valuable and a non valuable matter part,
- generating a return flow in a return pipe of a mixture of seawater and a non-valuable part of the matter from the processing platform towards the bottom of the body of water,
- controlling the pressure in the return pipe for avoiding collapse of the return pipe and/or cavitation in the return pipe, in particular for avoiding collapse of or cavitation in an upper part of the return pipe.

Because of the control of the pressure in the return pipe, the structural integrity of the pipe can be maintained while optimising use of the pipe capacity. In addition, the pressure control enables to recover energy from the return flow.

The problem with returning a slurry heavier than water is that if the hydrostatic pressure of the column is higher than the friction losses in the pipe, the matter will accelerate and a vacuum might be created in the top sections of the return pipe. This vacuum might lead to collapse of the pipes. In known non-mining systems, such as fall pipe vessels, the dumping rate as well as the water flow can be controlled, and thereby the whole process is controllable. In mining systems however, the return flow depends on the production flow, and the matter as well as the water flow are pre-determined and not flexible. Now, according to the invention by controlling actively the vacuum in the return pipe, the required flexibility can be achieved.

The invention is particularly useful for return pipes which at least partly operate according to a free fall principle. It will however be clear that in a pressure driven return flow, a "free fall" may occur as well.

Where the invention relates to mining operations and a matter flow, WO2012091706 distinctively relate to operations concerning an oil- or gas-flow. The oil- and gas operations is a different technical field compared with mining operations mainly because of the different flow which imposes different requirements to systems and operations.

Deep sea here means seas having a depth of at least 500 meters, preferably at least 1000 meters.

A matter processing platform may be a vessel, a subsea system or even a system supported by the bottom of the body of water like an ocean.

Examples of processes performed at the matter processing platform are for instance: The flow of excavated matter may be separated into a valuable matter part like gas, oil and/or hydrates, and a non valuable matter part, like water. Also, moisture may be removed from the upward flow of excavated matter by a "dehydration module". Optionally gas may be compressed. In addition, water may be injected in the return flow which (sea)water may have been pre-treated before injection.

In an embodiment of the method according to the invention, controlling the pressure in the return pipe comprises measuring an internal return pipe pressure for providing a return pipe pressure signal.

In an embodiment of the method, controlling the pressure in the return pipe comprises controlling the flow rate of the return flow.

In an embodiment of the method, controlling the flow rate of the return flow comprises providing pressure control means.

As an option, a buffer, or intermediate buffers, may be created at the top of the return pipe, and create a proportional feed of material to the return pipe. Consequence of this is the deck space and load capacity required to maintain this buffer.

In an embodiment of the method, the pressure control means comprise active and/or passive means.

In an embodiment of the method, the pressure control means are selected from restrictions like a smaller pipe diameter, systems of bends, turbines, pumps used as turbines, pumps, and control means for height of mixture column.

These pressure control means act in other words as means for energy dissipation which will be included in the return piper or also line of the system to make the vacuum controllable by balancing the dissipation losses (i.e. pipe resistance) with the potential energy, and—if possible—to recapture part of potential energy dissipated by the system.

In an embodiment of the method, controlling the flow rate of the return flow comprises, operating the pressure control means in response to the return pipe pressure signal.

In an embodiment of the method, the pressure control means operates within a response time limit in response to the return pipe pressure signal, wherein the response time limit is between lower 0.5 seconds and 10 seconds, preferably between 1 second and 5 seconds.

The excavated matter may comprise gas hydrates.

According to a further aspect of the current invention the object is realized with a deep sea mining flow control system for a return line, the system comprising;

- a measurement means for measuring an internal pressure of a return pipe for providing a return pipe pressure signal, pressure control means for controlling a return flow in the return pipe of a mixture of seawater and a non valuable matter part from a processing platform towards a bottom of a body of water, In an embodiment of the deep sea mining flow control system, the pressure control means comprise active and/or passive means.

In an embodiment of the deep sea mining flow control system, the pressure control means are selected from restrictors, systems of bends, turbines, pumps used as turbines, pumps, and control means for height of mixture column.

According to an even further aspect of the current invention the object is realized with a deep sea mining system comprising a flow control system for a return line;

a riser line for therein generating an upward flow of valuable matter from a bottom of a body of water to a matter processing platform, the matter processing platform for processing matter into a valuable and a non valuable matter part, a return pipe for therein generating a return flow of a mixture of seawater and a non-valuable part of the matter from the processing platform towards the bottom of the body of water, and a deep sea mining flow control system according to the invention for controlling the pressure in the return pipe for avoiding collapse of the return pipe and/or cavitation in the return pipe, in particular for avoiding collapse of and/or cavitation in an upper part of the return pipe.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF DRAWINGS

The invention will be further elucidated referring to a preferred embodiment shown in the drawing wherein shown in:

FIG. 1 a schematic side view of a deep sea mining system according to the invention

DETAILED DESCRIPTION OF EMBODIMENTS

In the FIGURE a deep sea mining system 1 is party shown. The deep sea mining system comprises a flow control system 3*a-c* for a return line 6. The deep sea mining system comprises a matter processing platform 2 for processing matter into a valuable and a non valuable matter part. The deep sea mining system 1 comprises a riser line 4 for therein generating an upward flow 5 of valuable matter from a bottom of a body of water 8 to the matter processing platform 2.

The deep sea mining system 1 comprises a return pipe 6 for generating a return flow 7 of a mixture of seawater and a non-valuable part of the matter from the processing platform 2 towards the bottom of the body of water.

The deep sea mining system 1 comprises a deep sea mining flow control system 3*a-c* for controlling the pressure in the return pipe 6 for avoiding collapse of the return pipe 6. Examples of such flow control systems are restrictors, systems of bends, turbines, pumps used as turbines, and pumps.

It will also be obvious after the above description and drawings are included to illustrate some embodiments of the invention, and not to limit the scope of protection.

Starting from this disclosure, many more embodiments will be evident to a skilled person which are within the scope of protection and the essence of this invention and which are obvious combinations of prior art techniques and the disclosure of this patent.

The invention claimed is:

1. Method for deep sea mining comprising;

generating an upward flow of excavated matter in a riser line from the bottom of a body of water to a matter processing platform with a first pressure system, processing the matter at the processing platform into a valuable and a non valuable matter part, generating a return flow in a return pipe separate from the riser line and with a second pressure system, the return flow comprising a mixture of seawater and the non-valuable part of the matter from the processing platform towards the bottom of the body of water, controlling the pressure in the second pressure system of the return pipe for avoiding collapse of the return pipe and/or cavitation in the return pipe.

2. Method according to claim 1, wherein controlling the pressure in the return pipe comprises measuring an internal return pipe pressure for providing a return pipe pressure signal.

3. Method according to claim 1, wherein controlling the pressure in the return pipe comprises controlling the flow rate of the return flow.

4. Method according to claim 1, wherein controlling the flow rate of the return flow comprises providing pressure control means.

5. Method according to claim 4, wherein the pressure control means comprise active and passive means.

6. Method according to claim 5, wherein the pressure control means are selected from restrictions, systems of bends, turbines, pumps used as turbines, pumps, and control means for height of mixture column.

7. Method according to claim 4, wherein controlling the flow rate of the return flow comprises, operating the pressure control means in response to the return pipe pressure signal.

8. Method according to claim 7, wherein the pressure control means operates within a response time limit in response to the return pipe pressure signal, wherein the response time limit is between 0.5 seconds and 10 seconds.

9. Method according to claim 1, wherein the matter comprises gas hydrates.

10. The method according to claim 1, wherein the pressure control means are passive pressure control means.

11. The method according to claim 1, wherein the pressure control means are selected from restrictions, systems of bends, and control means for height of mixture column.

12. Deep sea mining flow control system for a return line which has a separate pressure system than an upward flow line of the deep sea mining flow control system, the system comprising;

a measurement means for measuring an internal pressure of a return pipe for providing a return pipe pressure signal, pressure control means for controlling a return flow in the return pipe of a mixture of seawater and a non valuable matter part from a processing platform towards a bottom of a body of water for avoiding collapse of the return pipe and/or cavitation in the return pipe.

13. Deep sea mining flow control system according to claim 12, wherein the pressure control means comprise active and passive means.

14. Deep sea mining flow control system according to claim 13, wherein the pressure control means are selected from restrictors, systems of bends, turbines, pumps used as turbines, pumps, and control means for height of mixture column.

15. Deep sea mining system comprising;

a matter processing platform for processing matter into a valuable and a non valuable matter part, a riser line for therein generating an upward flow of excavated matter from a bottom of a body of water to the matter processing platform with a first pressure system, a return pipe for therein generating a return flow separate from the riser line and with a second pressure system, the return flow comprising mixture of seawater and the non-valuable matter part from the processing platform towards the bottom of the body of water, and a deep sea mining flow control system according to claim 12 for controlling the pressure in the return pipe for avoiding collapse of the return pipe and/or cavitation in the return pipe.

* * * * *